US007118517B1

(12) United States Patent
Hale

(10) Patent No.: US 7,118,517 B1
(45) Date of Patent: Oct. 10, 2006

(54) EXERCISE BALL MOUNTED FOR ROTATION

(76) Inventor: Thomas J. Hale, 19115 Beckett Dr., Odessa, FL (US) 33556

( * ) Notice: Subject to any disclaimer, the term of this patent is extended or adjusted under 35 U.S.C. 154(b) by 0 days.

(21) Appl. No.: 11/163,448

(22) Filed: Oct. 19, 2005

Related U.S. Application Data

(60) Provisional application No. 60/594,463, filed on Apr. 11, 2005.

(51) Int. Cl.
*A63B 26/00* (2006.01)
*A63B 71/00* (2006.01)

(52) U.S. Cl. ..... 482/140; 482/907; 482/91

(58) Field of Classification Search ..... 482/140, 482/91–95, 135–137, 907; 446/220; D21/662, D21/664, 687
See application file for complete search history.

(56) References Cited

U.S. PATENT DOCUMENTS 5,690,389 A 11/1997 Ekman et al.
5,810,700 A 9/1998 Orcutt
5,833,587 A 11/1998 Strong et al.
6,309,331 B1 10/2001 Raymond
6,461,284 B1 * 10/2002 Francavilla ..... 482/142
6,478,721 B1 11/2002 Hunter
6,669,611 B1 12/2003 Raymond
6,746,372 B1 6/2004 Hsu

* cited by examiner

*Primary Examiner*—Lori Amerson
(74) *Attorney, Agent, or Firm*—Michael M. McGaw; Smith & Hopen, P.A.

(57) ABSTRACT

An exercise apparatus for developing strength and flexibility of the arms, legs, back and abdominals of the user. The exercise apparatus is an adaptation of the exercise ball or Swiss ball. The exercise apparatus includes a large, spherically-shaped, resilient ball, a frame and a pair of connectors, the connectors rotatably connecting the ball to the frame. Various attachments may be placed on the frame to allow the user to grasp the apparatus or lock their feet to prevent unwanted motion. A mechanism can also be included in the connectors allowing the user to selectively adjust the rotation to a desired degree of resistance.

9 Claims, 8 Drawing Sheets

EXERCISE BALL MOUNTED FOR ROTATION

CROSS-REFERENCE TO RELATED APPLICATION

This application claims priority to U.S. Provisional Patent Application No. 60/594,463, filed Apr. 11, 2005, the contents of which are herein incorporated by reference.

FIELD OF INVENTION

This invention relates to an exercise device. More particularly this invention relates an exercise device based upon an exercise ball where the exercise ball is secured to facilitate rotation about an axis.

BACKGROUND OF THE INVENTION

An exercise ball is a large, spherical, resilient ball that can be used for a variety of exercises. These balls are also commonly referred to as a "Swiss ball", "Swiss exercise ball", "stability ball" or a "pilates ball." The ball is often inflatable, made of vinyl or plastic. Alternatively, it may be made of a solid material such as foam rubber. Exercise balls were originally used for therapeutic exercises, but have been more widely adopted in recent years to develop a user's flexibility, balance and strength, including the strength of seldom used stabilizer muscles. Exercise balls are typically used on the surface of a floor, with some portion of the weight of the user coming to rest upon the ball, thereby causing a deformation of the ball as it is pressed between the user and the floor. The resultant deformation adds a limited amount of resistance to the exercise. Used in this manner, the ball adds an element of instability to the exercise. This instability would not normally be experienced by a user with the associated exercise in the absence of the ball. Efforts by the user to counteract this instability and remain balanced on the ball allow the user to more fully exercise the body. One key cause of this instability is that the ball is not secured in any manner, other than by the weight of the user. Consequently, the ball is free to travel in any two dimensional direction by means of rotation across the horizontal plane created by the underlying floor.

The inherent characteristics of exercise balls have led to the recognition of numerous therapeutic uses for them. Due in part to these uses and characteristics, exercise balls have been incorporated into a number of exercise devices and other articles. U.S. Pat. No. 5,810,700 to Orcutt discloses an exercise apparatus utilizing a resilient ball and having a flexible strap assembly surrounding the ball. The flexible strap assembly coupled to the ball provides resistance for performing exercises. The resilient ball is designed to be used by a user in a seated position atop the ball, or otherwise with the user resting a portion of his or her body on the resilient ball, while pulling the resistance member in an elongation direction. The strap assembly includes first and second straps adapted to surround and couple to the resilient ball. A loop formed from one of the straps receives the resistance member. While providing additional exercises for use with an exercise ball, this device does not address the inherent instability of exercise balls.

U.S. Pat. No. 6,309,331 B1 to Raymond discloses an abdominal exerciser device utilizing a resilient rubber ball in contact with a plurality of ball bearings across the lower half of the ball. The ball is mounted inside a semi-spherical cavity that roughly corresponds in height to the lower half of the ball. Thus, a self-standing casing is formed to support the ball while allowing the rubber ball a free-rolling action when applied against a body part such as the abdominal, waist and/or hips effectively pressuring and massaging the muscles of the body part. It is further taught that one or more casings may also be mounted on absorbing materials, which is further mounted onto a rigid frame structure adapted to support a user. U.S. Pat. No. 6,669,611 B2, also to Raymond, discloses a similar abdominal exerciser.

U.S. Pat. No. 6,746,372 B2 to Hsu discloses an exercising ball holder for fixing an exercising ball. The holder is a concave device that cups the lower portion of an exercise ball. The holder further includes a base structure having multiple extension arms and at least one elastic cord attached thereto. The base seat is formed with a rest depression. A lower end of the exercising ball is rested and located in the depression preventing the ball from easily rolling out in response to directly downward pressure. The ball is free to be lifted out of the device and may be dislodged by forces applied from a side. The multiple extension arms extend outwardly from beneath the holder and have a fixing loop section at their respective ends for affixing the elastic cords. The elastic cords have handles at the ends opposite to where they affix to the base. The elastic cords are thus adapted to function as resistance members to be grasped by the hand of a user.

Other patents disclosing chairs or exercise devices incorporating exercise ball-like objects, or variations thereof, include U.S. Pat. No. 4,126,326 to Phillips, U.S. Pat. No. 5,690,389 to Ekman et al., U.S. Pat. No. 5,833,587 to Strong et al., U.S. Pat. No. 6,461,284 B1 to Francavilla, U.S. Pat. No. 6,478,721 to Hunter and U.S. Pat. No. 6,702,726 to Lin.

As discussed above, exercise balls are useful tools for exercise, but suffer from a number of limitations as a result of their ability to roll in any direction along the horizontal plane. Exercise balls are inherently unstable. Often this instability is not desired by the user. This instability often makes it more difficult to isolate the desired muscle group or groups intended by a particular exercise motion. The feeling of instability can be unnerving to inexperienced users and may even lead to injury due to loss of balance or when otherwise used improperly. This is especially true if the user suffers from a physical ailment or handicap. Additionally, the primary source of resistance during certain exercise is the compressed nature of the weight-bearing ball. One means for adjusting the resistance is to alter the inflation of ball. Deflating the ball results in an increased resistance to rotation. Unfortunately, this results in a concomitant reduction in support to the user. As such, it is difficult to adjust the resistance to tailor it to the exercise and the user's needs. Finally, because the ball is not secured by any means, it is difficult to firmly stabilize an isolated part of the user's body, such as the user's feet or hands, so as to apply a significant amount of force to be exerted during the motion of the exercise. Thus, what is needed is an exercise apparatus that overcomes these limitations.

SUMMARY OF INVENTION

The present invention provides an exercise device based upon the concept of the exercise ball. The device utilizes a user support means connected to a frame with one or more connectors. It is found advantageous to have a user support means adopting the rounded shape of a substantially spherical ball. Other rounded shapes are also contemplated including ovoid and cylindrical. The connectors facilitate connection between the ball and the frame, which facilitate rotation about the axis created between the connectors. In certain embodiments the connectors connecting the ball to the frame will utilize an axle passing through the center of the sphere. Alternatively, the connectors can be a pair of units at points substantially diametrically opposed on the surface of the ball. In such a configuration it would not be necessary to pass an axle through the center of the sphere. Nevertheless, an axis of rotation would exist between the two connectors and the ball would be securedly affixed to the frame. In certain embodiments the ball will rotate on the axle or other connectors, while the axle or other connectors remains statically-affixed to the frame. In other embodiments, the ball will be statically-affixed to the axle or other connectors, while the axle or other connectors rotate at the point of attachment to the frame.

In certain embodiments the device will include connectors that can be selectively adjusted to provide varying degrees of resistance to rotation. The frame can include a base to facilitate placement of the device on a flat planar surface or attachment to other devices, frames or exercise equipment. The frame can include one or more attachments. These attachments can be handles designed to be grasped by a user, footrests adapted to secure a user's foot or sites for further affixing articles such as strap-like resistance members or resistance bands. The frame can be further adapted to include a means for changing its dimensions or length. Changes in dimension or length may be desirable to adjust the location of the attachment members to the desired position or to further stabilize the device by increasing its base size.

Depending upon how the ball is configured within the frame and what attachments are added to the frame, numerous exercises are possible. In use, the user rests a portion of their body weight on the ball and exerts an applied force to rotate the ball. It is also possible that, using the variable resistance function of the connectors that the user could "lock" the ball in a static position to facilitate additional exercises.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
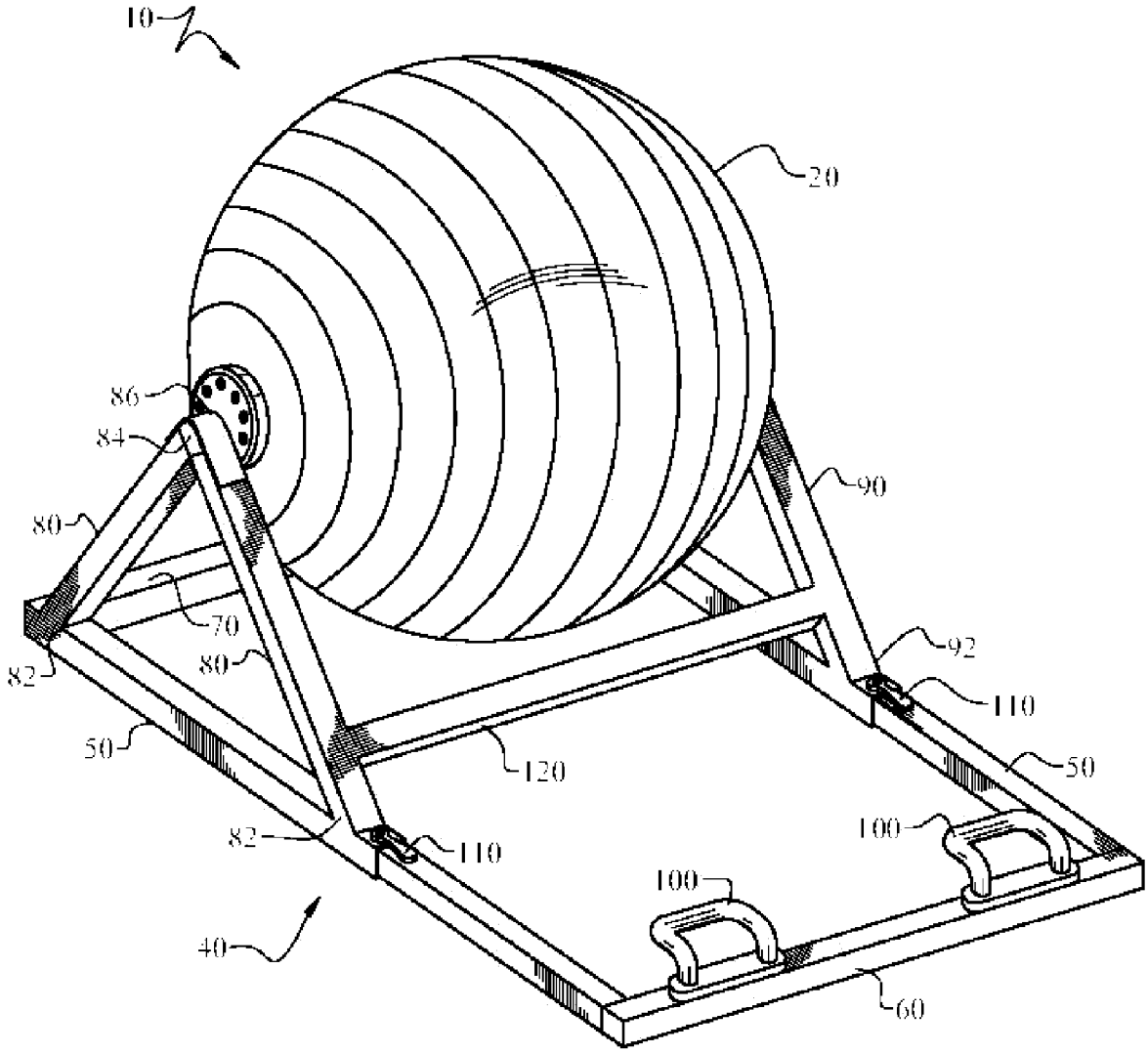
FIG. 1 is an illustration of a perspective view of one embodiment of the exercise ball mounted for rotation.
Figure 2:
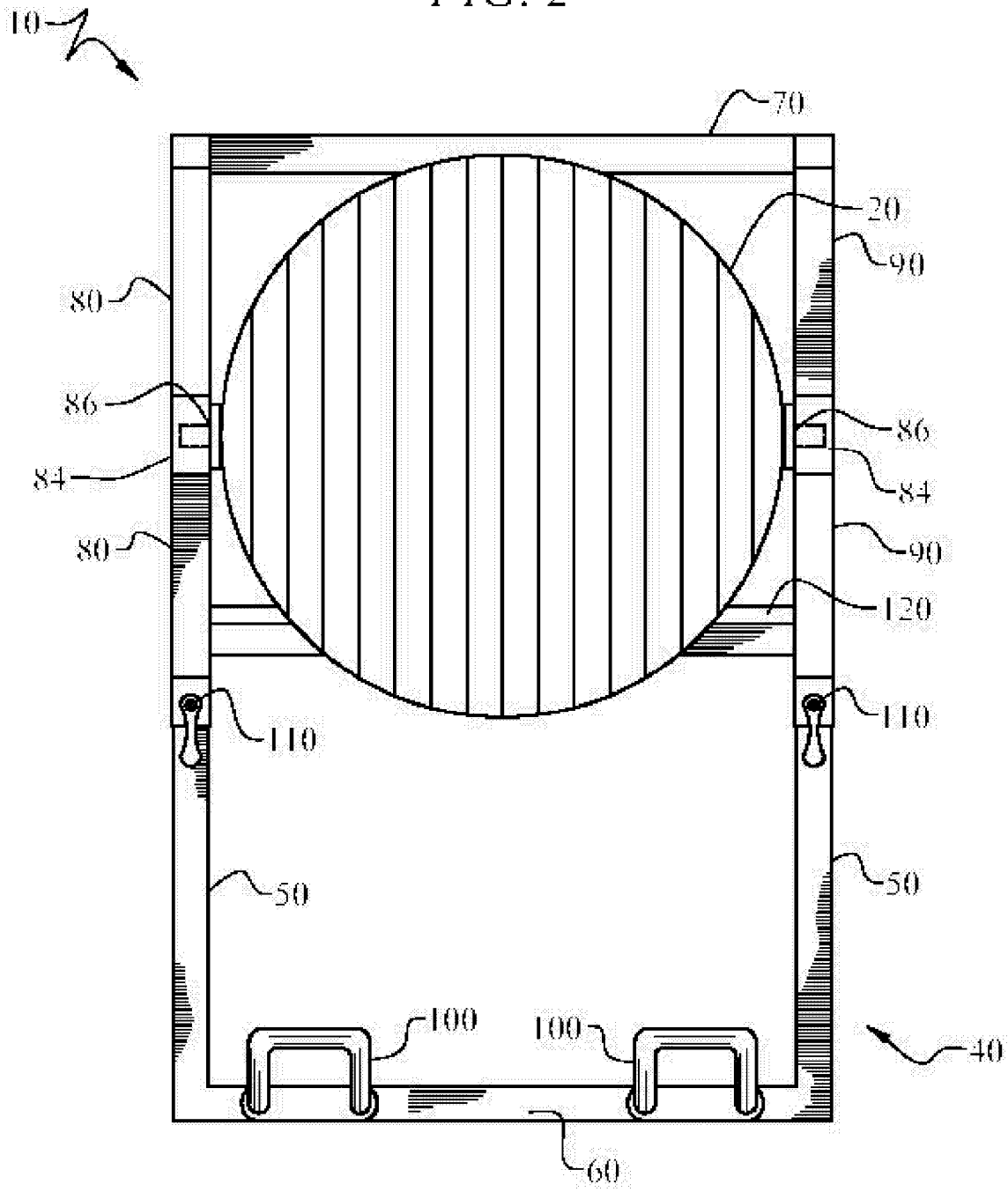
FIG. 2 is an illustration of a top plan view of the embodiment of the invention depicted in FIG. 1.

FIG. 1 shows an exercise device 10 according to an exemplary embodiment of the present invention. Exercise device 10 includes a user support means in the form of a substantially spherical, resilient ball 20 attached to a frame 40. The ball is adapted to support the weight of a user while the user performs exercises. It is contemplated that the user support means can adopt a shape other than that of a substantially spherical ball. For instance, the shape could be ovoid or cylindrical. The frame 40 rotatably supports the ball in vertically spaced relation to a support surface. The frame 40 includes a pair of longitudinally disposed base members 50 disposed in substantially parallel orientation in relation to one another. The front of the frame 40 includes a leading transversely disposed base member 60 that interconnects the respective leading ends of the pair of longitudinally disposed base members 50. The rear of the frame 40 includes a trailing transversely disposed base member 70 that interconnects respective trailing ends of the pair of longitudinally disposed base members 50. Taken together, the pair of longitudinally disposed base members 50, the leading transversely disposed base member 60 and the trailing transversely disposed base member 70 form the base of the device shown in the exemplary embodiment.

Extending upward from the base of the frame 40 are a first pair of support members 80 secured to a first longitudinally disposed base member of said pair of longitudinally disposed base members 50. The frame 40 includes a second pair of support members 90, one member of said pair not visible in this view, secured to a second longitudinally disposed base member of said pair of longitudinally disposed base members 50. The first pair of support members 80 have respective first ends 82 secured to the first longitudinally disposed base member in longitudinally spaced apart relation to one another and have respective second ends 84 that abut one another. The respective second ends 84 are vertically spaced relation to the respective first ends 82. Thus, the first pair of support members 80 form an inverted "V" configuration. The second pair of support members 90 have respective first ends 92 secured to the second longitudinally disposed base member in longitudinally spaced a part relation to one another and have respective second ends 94 (not visible in this view) that abut one another. The respective second ends 94 are vertically spaced relation to the respective first ends 92. Thus, the second pair of support members 90 also form an inverted "V" configuration. It is contemplated that the extent of the support members will be adjustable to facilitate altering the height of the ball relative to the support surface. It is further contemplated that support members 80 and 90, rather than being a pair of support members on each side of the device, will be formed of a single member on each side of the ball. In such an embodiment the support members form an "I" configuration. The respective second ends would be vertically spaced relation to the respective first ends. Constructed in this manner, the exercise apparatus will have fewer parts, making it lighter, and the common extent of the first pair of support members 80 and second pair of support members 90 will be more easily adjustable.

As indicated above, the first 80 and second 90 support members have a common extent. The common extent is at least slightly greater than a radius of the substantially spherical ball 20 so that the substantially spherical ball 20 is free to rotate about an axis defined between the diametrically opposed points. A brace 120 joining support member 80 and support member 90 provides additional rigidity to the frame.

The exercise apparatus 10 has a first rotatably mounted connector 86 disposed at an apex of said first pair of support members 80. The exercise apparatus 10 has a second rotatably mounted connector 96 (not visible in this view) disposed at an apex of the second pair of support members 90 in diametrically opposed relation to the first apex. The substantially spherical ball 20 is positioned between the first 80 and second 90 pair of support members. The first 86 and second 96 (not visible in this view) rotatably mounted connectors engage the substantially spherical ball 20 at diametrically opposed points on the substantially spherical ball 20. Mounted in this manner, 360° rotation of the ball in the desired axis is possible. Furthermore, rotation in all other axes is eliminated.

Figure 10:
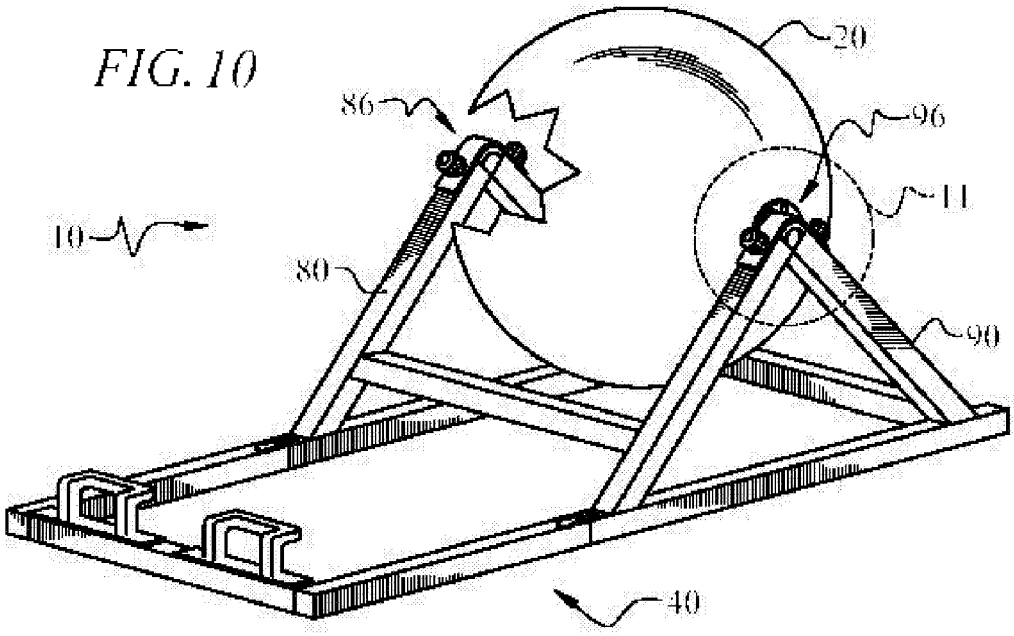
FIG. 10 is a perspective view illustrating an alternative embodiment of the invention depicted in FIG. 1. Illustrated is the addition of an adjustable rotation resistance device to alter the ball's resistance to rotation. In this view the exercise ball is partially cut-away to illustrate the support members. The figure further directs attention to the top of the support members wherein the rotating axle is affixed to the support members as illustrated in greater detail in FIG. 11.
Figure 11:
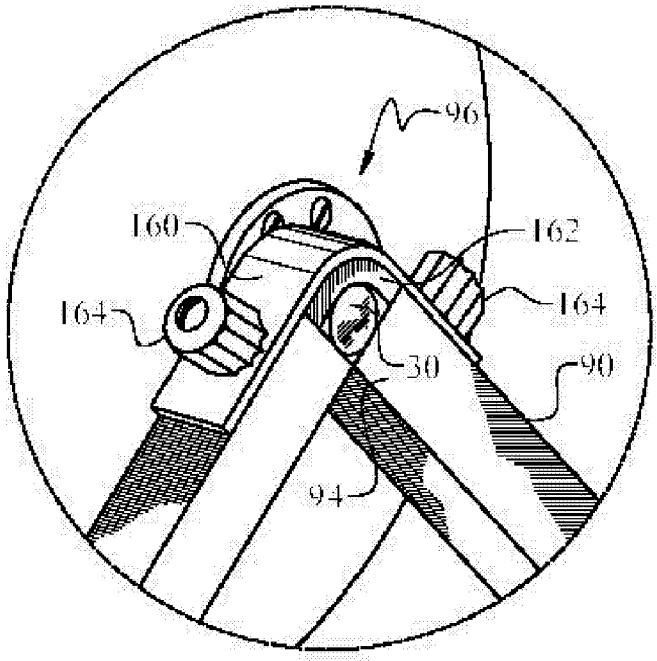
FIG. 11 is a perspective view illustrating an adjustable rotation resistance device to alter the ball's resistance to rotation.

The first 86 and second 96 rotatably mounted connectors may include a mechanism whereby the resistance to rotation may be selectively adjusted. Referring to FIG. 10 there is shown an embodiment of the invention having an adjustable rotation resistance device whereby the resistance to rotation may be selectively adjusted. FIG. 11 shows a close-up of the mechanism. The axle 30 is supported at the junction of pair of support members 90 at the second ends 94 of the support members. Sitting above the axle 30 is a pad 162. Plate 160 sits above the pad and links each support member 90 at their respective second ends 94. It is found advantageous to provide a pad 162 that has friction reducing properties such that the axle is firmly held while rotating without substantial noise. It is found that the degree of rotation can be limited by tightening the knobs 164 which results in a compression of pad 162 by plate 160. An alternative embodiment would replace the two knobs 164 with a single knob at the apex of the plate 160 and a pair of screws or other fasteners to affix the plate 160 to the support members 90. An additional small plate could be placed between the pad 162 and the plate 160. The additional small plate would place a compressible force on the pad 162 when adjusted by the knob 164. The knob 164 and the additional small plate could be linked by a screw threaded through plate 160.

Numerous other means for adjusting the resistance to rotation are possible. These can includes friction devices, magnets, and spring-loaded devices. A contemplated friction device would forcibly engage the connector in an adjustable manner. The applied pressure or degree to which the friction device engages connector would be proportionally related to the resistance to rotation of the ball in response to an applied rotational force. When the rotation adjusting device, be it a friction device or other, is disengaged, or at its minimal setting, the resistance to rotation created by the rotation adjusting device can be negligible. When adjusted to a maximal setting, the resistance to rotation created by the rotation adjusting means can completely prevent the ball from rotating. Additionally, a locking device can be included to prevent the ball from rotating when rotation is not desired. It is contemplated that an advantageous locking device can be incorporated at the connector.

Figure 6:
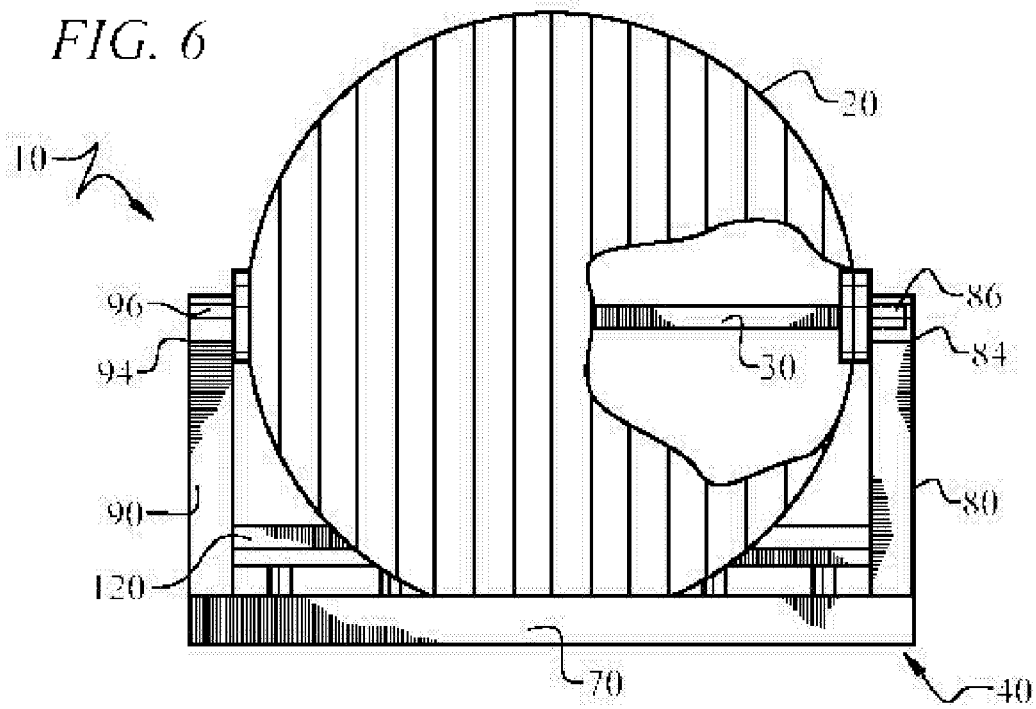
FIG. 6 is a rear elevation view of the embodiment of the invention depicted in FIG. 1. In this view the exercise ball is partially cut-away to illustrate an axle passing through the ball.

Referring to FIG. 6, an illustration of an exemplary embodiment of the exercise ball mounted for rotation is presented whereby the ball 20 is shown in cutaway to illustrate an axle 30 passing through the center of the ball. In this embodiment, the resilient ball is secured to the axle at diametrically-opposed points on the peripheral surface of the sphere. The axle is a central shaft for the rotating user support means. In some cases the axle may be fixed in position with a bearing, bushing or other mechanism sitting inside the hole in the ball or other user support means to allow for rotation of the user support means around the axle. In other cases the ball or other user support means may be fixed to the axle, with rotation provided at the mounting points where the axle is supported. It is further contemplated that the ball could be statically mounted on the central shaft, or other connector, thus preventing all rotation. This would be advantageous where a rounded object such as an exercise ball is desired, but it is further desired to eliminate all rotation, thus creating a static device, while also providing a rounded support surface that will not dislodge or otherwise move.

As discussed above, the exemplary embodiment depicted in FIG. 6 utilizes an axle passing through the center of the ball. With a sufficiently stiff axle, it is possible to secure the ball to the base 40 with a single support member on only one side of the user support means, rather then having support members on both sides.

Additional modes of connecting the ball are possible. The ball could be connected by a pair of connectors at diametrically opposed points without having an axle passing through the ball to link the connectors. The connectors attach the user support means to the frame and prevent dislodgement of the user support means during exercises. In such an embodiment, the absence of an axle would reduce the stiffness of the device. It may be desirable to regain some of the lost stiffness by adding one or more braces or gussets such as the brace 120 connecting the first 80 and second 90 pair of support members.

The exemplary embodiment utilizes a substantially spherical ball 20 as the user support means. The user support means is of round shape about the length of the shaft, axle or other axis of rotation and is adapted to support the weight of a user. The rounded shape of the substantially spherical ball is found to be particularly advantageous, although other shapes are possible. These shapes can include a ball having an ovoid shaped user support means and roller having a columnar-shaped user support means. The ball in the exemplary embodiment is a large, inflatable ball approximately 45 cm. to 85 cm. in diameter. The ball, or other user support means, can be smooth or it can have a textured surface to minimize slippage between the user and the ball. In the exemplary embodiment the ball has a series of parallel ridges around the circumference of the balls. It is found that such ridges aid in preventing slippage of a user from side-to-side on the device during use. When an inflatable ball is used, for safety reasons the ball is constructed from a resilient, puncture-resistant material which, when punctured, deflates slowly. Alternatively, the ball can be constructed of a solid material such as foam rubber or the like. It is further contemplated that the solid ball could sit on the axle maintaining continuous contact with the axle for the extent of the axle's passage through the ball. Similarly, an inflatable ball could maintain continuous contact with the axle by adopting an inner-tube like structure. The axle would then pass through the small hole in the center, with continuous contact between the axle and the tube for the extant of the axle's passage through the hole in the center of the tube. The ability to separately control the resistance to rotation and the inflation level of the ball allows the properties of the device to be custom tailored in ways that are not possible with a standard exercise ball.

Referring again to FIG. 1, the device can further include one or more attachment members 100 affixed to the frame. The attachment members can be affixed to the frame at numerous locations including the pair of longitudinally disposed base members 50 or the leading transversely disposed base member 60. For instance, a pair of attachment members can be affixed to the frame at the leading transversely disposed base member 60. The attachment member can be a handle adapted to be grasped by hands of a user. In such a configuration a user would be able to perform exercises such as a push-up on the device by grasping the handles and placing his legs atop the ball. The push-up can then be performed by a lowering motion of the body facilitated by a bending of the elbows. Alternatively, the attachment member can be a foot rest adapted to the engaged by a foot of a user handle adapted to be grasped by hands of a user. In this a configuration a user would be able to perform exercises such as a sit-up on the device with a degree of stability well beyond that which can be achieved by a conventional exercise ball. Also contemplated are attachment members that are resistance devices. These can include elastic bands, springs, pulleys and other objects that provide resistance in response to the applied force of a user. For example, bands constructed of a resilient material could be affixed to the frame to allow a user to perform various extension and contraction exercises, such as bicep curls or tricep extensions, while positioned on the apparatus. It is also contemplated that these members could pass through a frame having a tubular structure to provide a streamlined effect and to isolate the moving parts of the attachment from the user to minimize the likelihood of injury.

Figure 3:
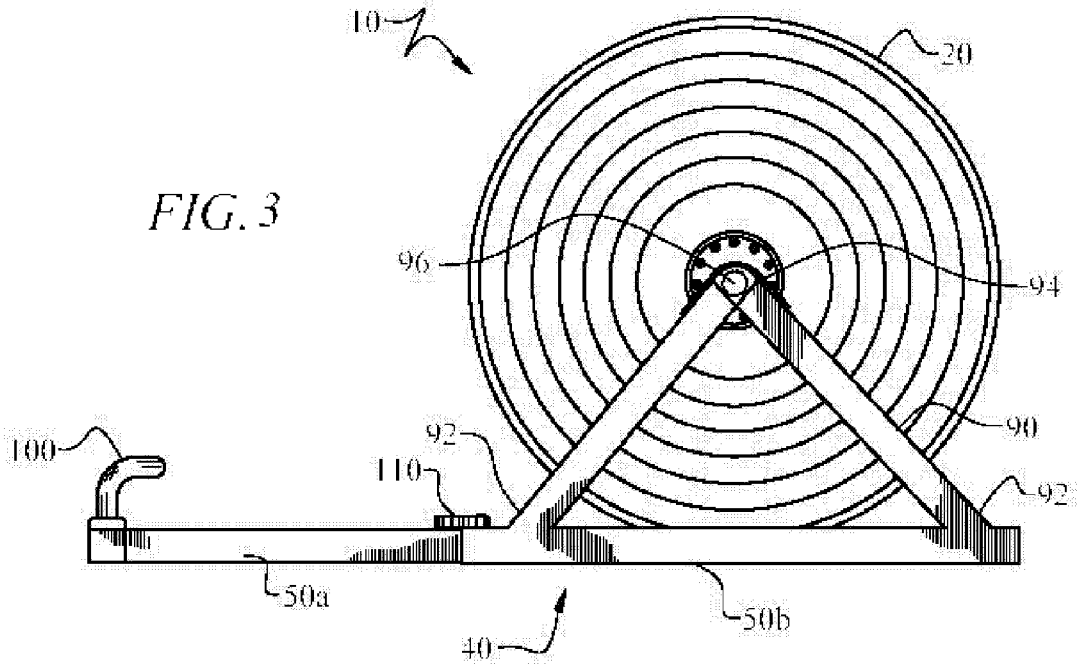
FIG. 3 is an illustration of a right side elevation view of the embodiment of the invention depicted in FIG. 1.
Figure 4:
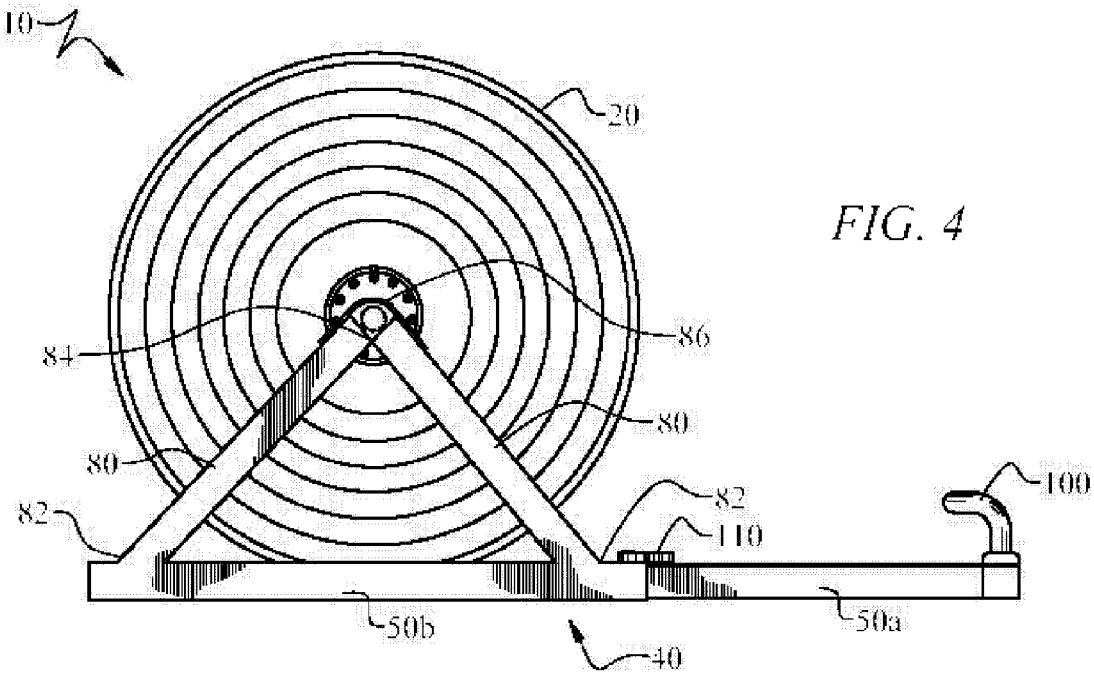
FIG. 4 is an illustration of a left side elevation view of the embodiment of the invention depicted in FIG. 1.
Figure 5:
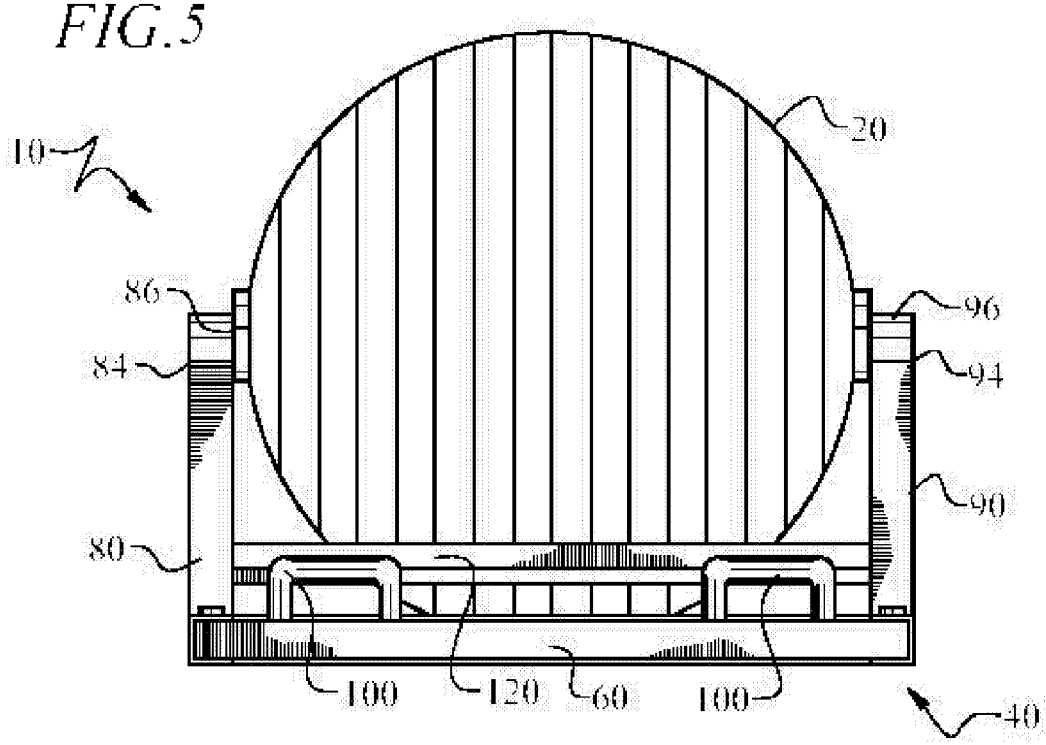
FIG. 5 is an illustration of a front elevation view of the embodiment of the invention depicted in FIG. 1.

FIG. 1 shows an embodiment of the apparatus having an elongated base of adjustable length formed by the pair of longitudinally disposed base members 50, a leading transversely disposed base member 60 and a trailing transversely disposed base member 70. Referring to FIG. 3 it is illustrated that the longitudinally disposed base members are formed by a trailing section of the longitudinally disposed base member 50*b* that slidingly receives a leading section of the longitudinally disposed base member 50*a*. The length of the pair of longitudinally disposed base members 50 can be adjusted by sliding the leading segments of the longitudinally disposed base members 50*a* into or out of their respective trailing portions segments of the longitudinally disposed base members 50*b*. Once the desired position is achieved, this position may be secured by locking the releases 110.

Figure 7:
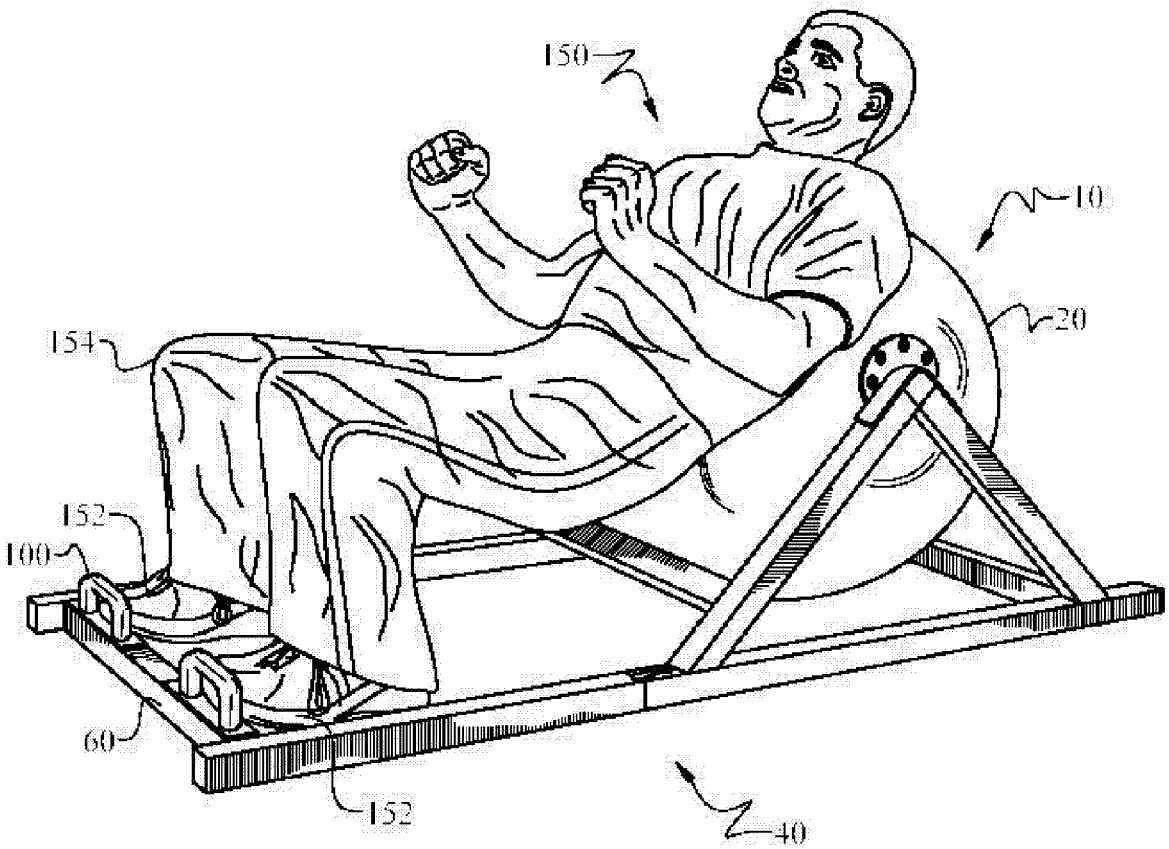
FIG. 7 is a perspective view illustrating the use of the embodiment as shown in FIG. 1 in performing a squat exercise by a user where the user is depicted in the squatted position with knees bent.
Figure 8:
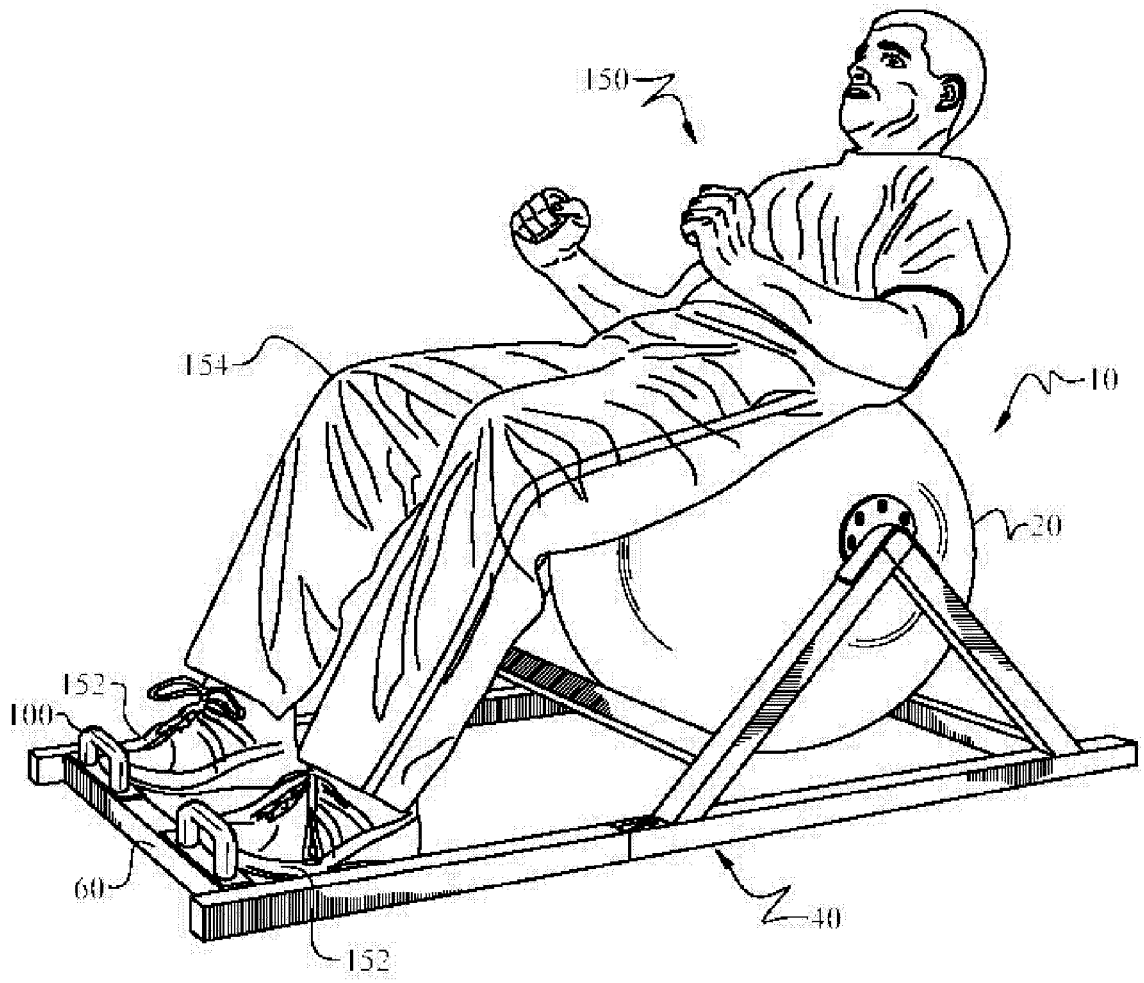
FIG. 8 is a perspective view illustrating the exercise depicted in the FIG. 7 where the user is depicted out of the squatted position with legs in the extended position.

Referring to FIG. 7, an illustration of an exemplary embodiment of the exercise ball mounted for rotation 10 is presented whereby a user 150 is performing a squat exercise. The user 150 has his weight supported by having his upper back in contact with the exercise ball 20. The user's feet 152 are optionally secured by the attachment members 100 affixed to the leading transverse base member 60. The user's knees 154 are flexed position placing the user in a squatted position. From this point the user will exert force with the muscles of the legs and buttocks, principally the muscle groups of the quadriceps, hamstrings and gluteus maximus, causing an extension of the user's legs and reducing the flexion of the user's knees 154. As the user performs this motion, the exercise ball 20 will rotate in a clockwise direction in relation to the view depicted in FIG. 7 and the user will arrive in the position depicted in FIG. 8. FIG. 8 is another illustration of the exercise depicted in FIG. 7 with the user 150 in a more extended position in the squat exercise relative to the position depicted in FIG. 7. It can be seen that the user's feet 152 remain secured by the attachment members 100, although it is now the user's buttocks and lower back that are in contact with the exercise ball. Additionally, the flexion in the user's knees 154 has been reduced. It should be apparent from the foregoing that a multitude of other exercises are possible with the invention.

Figure 9:
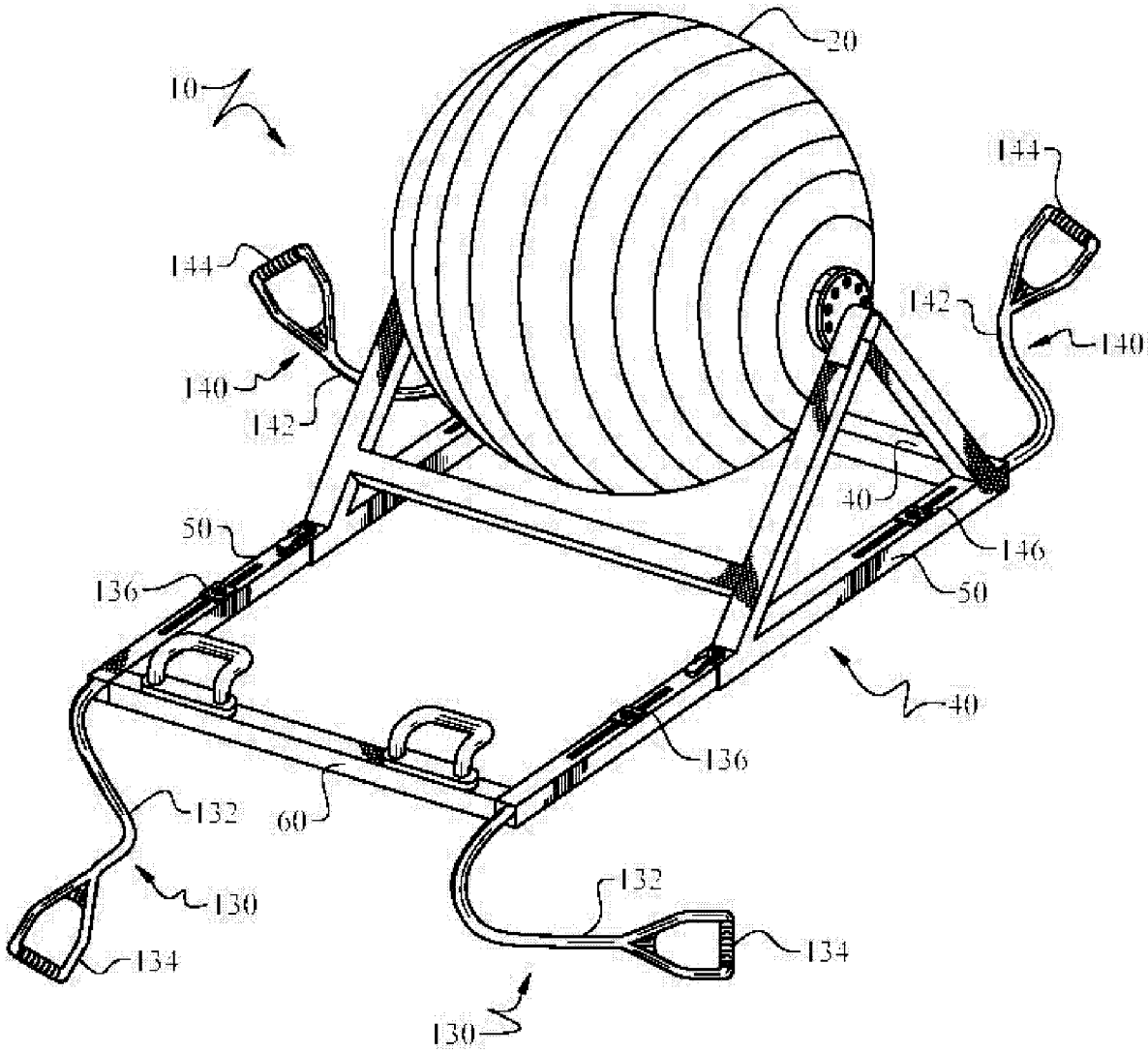
FIG. 9 is a perspective view illustrating an alternative embodiment of the invention depicted in FIG. 1. Illustrated is the addition of rotation resistance devices attached to the base of the apparatus.

Referring to FIG. 9, an illustration of an exemplary embodiment of the exercise ball mounted for rotation is presented whereby an embodiment is depicted with resistance bands 130 affixed within the longitudinally disposed base members 50 and exiting at the junction of the longitudinally disposed base members 50 with the leading transversely disposed base member 60. Resistance releases 136 slidingly secure the resistance bands 130 the within the longitudinally disposed base members 50. By sliding the resistance releases 136 along the longitudinally disposed base members 50 the length of the exposed portion of the extension 132 of the resistance bands 130 can be adjusted. When the desired length is achieved the resistance releases 136 can be secured in place. The resistance bands 130 may include a handle 134 adapted to be grasped by the hand of a user. It is further contemplated that the resistance bands can be interchanged based upon a user strength and preference as to the amount of resistance offered by the device. It is contemplated that the resistance bands 130 can be used for various exercises such as curls, where the user places his knees adjacent to the trailing transversely disposed base member 70 while resting his chest upon the ball 20 and grasping the handles 134 with his hands. In an advantageous embodiment the extension 132 of the resistance bands will be composed of an elastic material. It is also possible that resistance could be provided by coupling the bands to a spring or a pulley mechanism.

Resistance bands 140 are also depicted in the illustration. Resistance bands 140 are affixed within the longitudinally disposed base members 50 and exiting at the junction of the longitudinally disposed base members 50 with the trailing transversely disposed base member 70. Resistance releases 146 slidingly secure the resistance bands 140 within the longitudinally disposed base members 50. By sliding the resistance releases 146 along the longitudinally disposed base members 50 the length of the exposed portion of the extension 142 of the resistance band 140 can be adjusted. The resistance bands may include a handle 144 adapted to be grasped by the hand of a user. It is contemplated the resistance bands 140 can be used for various exercises such as a chest fly, where the user places his feet adjacent to attachment members 100 while resting his back upon the ball 20 and grasping the handles 144 with his hands.

It is further contemplated that the ball could be heated as an aid to the user. The therapeutic properties of exercise balls are well-known. These balls are frequently used in stretching and recuperation from injuries involving range of motion. By incorporating a heating element, such as those found in thermal electric heating pad systems used for patient warming applications, a great benefit can be achieved for user comfort. It would be especially advantageous to include a control unit to selectively adjust the temperature of the thermal unit to achieve the desirable level of heat.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An exercise apparatus comprising:

a substantially spherical ball;

a frame for rotatably supporting said substantially spherical ball in vertically spaced relation to a support surface;

said frame including a pair of longitudinally disposed base members disposed in substantially parallel, transversely disposed in relation to one another;

said frame including a leading transversely disposed base member that interconnects respective leading ends of said pair of longitudinally disposed base members;

said frame including a trailing transversely disposed base member that interconnects respective trailing ends of said pair of longitudinally disposed base members;

said frame including a first pair of support members secured to a first longitudinally disposed base member of said pair of longitudinally disposed base members;

said frame including a second pair of support members secured to a second longitudinally disposed base member of said pair of longitudinally disposed base members;

said first pair of support members having respective first ends secured to said first longitudinally disposed base member in longitudinally spaced apart relation to one another and having respective second ends that abut one another, said respective second ends being in vertically spaced relation to said respective first ends, said first pair of support members forming an inverted "V" configuration;

said second pair of support members having respective first ends secured to said second longitudinally disposed base member in longitudinally spaced apart relation to one another and having respective second ends that abut one another, said respective second ends being in vertically spaced relation to said respective first ends, said second pair of support members forming an inverted "V" configuration;

a first rotatably mounted connector disposed at an apex of said first pair of support members;

a second rotatably mounted connector disposed at an apex of said second pair of support members in diametrically opposed relation to said first apex;

said substantially spherical ball being positioned between said first and second pair of support members;

said first and second rotatably mounted connectors engaging said substantially spherical ball at diametrically opposed points on said substantially spherical ball;

said first and second support members having a common extent, said common extent being at least slightly greater than a radius of said substantially spherical ball so that said substantially spherical ball is free to rotate about an axis defined between said diametrically opposed points.

2. The apparatus according to claim 1 further comprising an adjustable bearing coupled to at least one of the rotatably mounted connectors whereby increasing the engagement of the bearing provides corresponding resistance to rotation.

3. The apparatus according to claim 1 further comprising at least one attachment member affixed to the leading transversely disposed base member.

4. The apparatus according to claim 3 wherein the attachment member is a handle adapted to be engaged by a hand of a user.

5. The apparatus according to claim 3 wherein the attachment member is a foot rest adapted to be engaged by a foot of a user.

6. The apparatus according to claim 1 wherein the length of the pair of longitudinally disposed base members is adjustable.

7. An exercise apparatus comprising:

a user support means adapted to support a user performing exercises thereon;

an axle, the user support means mounted for rotation on the axle;

a frame engaging the axle, the frame rotatably supporting the user support means in vertically spaced relation to a support surface; and at least one attachment member affixed to the frame, wherein the attachment member is a resistance band adapted to provide resistance in response to the applied force of a user performing an exercise.

8. An exercise apparatus comprising:

a user support means adapted to support a user performing exercises thereon;

an axle, the user support means mounted for rotation on the axle;

a frame engaging the axle, the frame rotatably supporting the user support means in vertically spaced relation to a support surface; and a heating element to heat the surface of the user support means.

9. An exercise apparatus comprising:

a frame;

a user support means adapted to support a user performing exercises thereon;

a pair of connectors in diametrically opposed relation, the connectors connecting the user support means to the frame, the frame supporting the user support means in vertically spaced relation to a support surface; and at least one attachment member affixed to the frame, wherein the attachment member is a resistance band adapted to provide resistance in response to the applied force of a user performing an exercise.

* * * * *